US010415174B2

(12) United States Patent
Park et al.

(10) Patent No.: US 10,415,174 B2
(45) Date of Patent: Sep. 17, 2019

(54) WASHING MACHINE

(71) Applicant: Samsung Electronics Co., Ltd., Suwon-si, Gyeonggi-do (KR)

(72) Inventors: Jang Hoon Park, Suwon-si (KR); Min Jea Choi, Suwon-si (KR); Jae Young Kim, Suwon-si (KR); Zoo Hyeong Kim, Suwon-si (KR); Nae Young Park, Seoul (KR); Kwang Min Chun, Suwon-si (KR)

(73) Assignee: Samsung Electronics Co., Ltd., Suwon-si (KR)

( * ) Notice: Subject to any disclaimer, the term of this patent is extended or adjusted under 35 U.S.C. 154(b) by 0 days.

(21) Appl. No.: 15/868,707

(22) Filed: Jan. 11, 2018

(65) Prior Publication Data

US 2018/0135231 A1 May 17, 2018

Related U.S. Application Data

(63) Continuation of application No. PCT/KR2016/008889, filed on Aug. 12, 2016.

(30) Foreign Application Priority Data

Aug. 27, 2015 (KR) ..... 10-2015-0120875

(51) Int. Cl.
*D06F 39/14* (2006.01)
*D06F 37/10* (2006.01)
(Continued)

(52) U.S. Cl.
CPC ..... *D06F 39/14* (2013.01); *D06F 37/10* (2013.01); *D06F 37/266* (2013.01); *D06F 37/28* (2013.01)

(58) Field of Classification Search
CPC ..... D06F 39/14; D06F 37/266; D06F 37/10; D06F 37/28; D06F 37/22; D06F 37/269; D06F 37/06; D06F 37/42
(Continued)

(56) References Cited

U.S. PATENT DOCUMENTS 2,296,264 A * 9/1942 Breckenridge ..... D06F 33/06 220/324
2,813,414 A * 11/1957 Johnston ..... D06F 25/00 34/596
(Continued)

FOREIGN PATENT DOCUMENTS

AU 2016224314 A1 10/2016
EP 1262589 A2 12/2002
(Continued)

OTHER PUBLICATIONS

ISA/KR, International Search Report and Written Opinion of the International Searching Authority, International Application No. PCT/KR2016/008889, dated Nov. 15, 2016, 5 pages.
(Continued)

*Primary Examiner* — Hiwot E Tefera

(57) ABSTRACT

A washing machine includes: a cabinet having a first opening and a washing space formed therein; and a door assembly provided to open and close the first opening, wherein the door assembly includes: a door body having a second opening and corresponding to the first opening and provided to rotate relative to the cabinet; door glass having a glass hole communicating with the inside of the cabinet and coupled with the rear surface of the door body; a guide duct that connects the second opening and the glass hole; and a sealing member. The sealing member can prevent washing water or internal air from escaping from the door assembly.

12 Claims, 16 Drawing Sheets

(51) Int. Cl.
*D06F 37/28* (2006.01)
*D06F 37/26* (2006.01)

(58) Field of Classification Search
USPC ..... 68/196, 24, 58, 139; 312/228
See application file for complete search history.

(56) References Cited

U.S. PATENT DOCUMENTS

| | | | | |
|---|---|---|---|---|
| 3,505,836 | A * | 4/1970 | Langston | D06F 39/12 68/208 |
| 6,256,823 | B1 * | 7/2001 | Kronbetter | D06F 37/266 68/139 |
| 6,442,981 | B1 * | 9/2002 | Augustsson | D06F 37/266 68/139 |
| 8,499,592 | B2 * | 8/2013 | Gokceimam | D06F 39/14 312/228 |
| 8,844,328 | B2 * | 9/2014 | Loss | D06F 37/28 312/326 |
| 9,340,917 | B2 * | 5/2016 | Carrillo | D06F 37/266 |
| 2004/0020246 | A1 * | 2/2004 | Yun | D06F 37/28 68/24 |
| 2006/0053842 | A1 * | 3/2006 | Je | D06F 39/02 68/17 R |
| 2007/0125132 | A1 * | 6/2007 | Hwang | D06F 39/14 68/3 R |
| 2009/0165390 | A1 * | 7/2009 | Yoon | D06F 39/14 49/478.1 |
| 2009/0165391 | A1 * | 7/2009 | Kocak | D06F 39/14 49/480.1 |
| 2016/0369445 | A1 * | 12/2016 | Kim | D06F 39/14 |

FOREIGN PATENT DOCUMENTS

| | | | |
|---|---|---|---|
| EP | 1634987 | A1 | 3/2006 |
| EP | 2415920 | A1 | 2/2012 |
| EP | 3115494 | A1 | 1/2017 |
| EP | 3263757 | A1 | 1/2018 |
| EP | 3342915 | A1 | 7/2018 |
| KR | 10-2004-0015480 | A | 2/2004 |
| KR | 10-2009-0096948 | A | 9/2009 |
| KR | 10-2010-0081232 | A | 7/2010 |
| KR | 20120050633 | A | 5/2012 |
| KR | 10-2016-0103888 | A | 9/2016 |

OTHER PUBLICATIONS

Examination Report No. 1 for Standard Patent Application for Australian Patent Application No. 2016310964 dated May 25, 2018; 3 pages.
Extended European Search Report for European Patent Application No. 16839486.4 dated Apr. 4, 2018; 5 pages.
Grounds for Rejection for Korean Patent Application No. 10-2015-0120875 dated Aug. 29, 2017; 8 pages.
Notice of Final Rejection for Korean Patent Application No. 10-2015-0120875 dated Mar. 29, 2018; 5 pages.
Notice of Allowance for Korean Patent Application No. 10-2015-0120875 dated May 14, 2018; 7 pages.
Instituto Nacional De Propiedad Industrial (INAPI) Chile, Office Action for Application No. CL201703049 dated Dec. 18, 2018, 14 pages.
Notice of acceptance for patent application dated Oct. 3, 2018 in connection with Australian Patent Application No. 2016310964, 3 pages.
Office Action dated Nov. 2, 2018 in connection with European Patent Application No. 16 839 486.4, 4 pages.
European Patent Office, Communication pursuant to Article 94(3) EPC in European Patent Application No. EP16839486.4, dated Jul. 18, 2019, 4 pages.
Instituto Nacional de Propiedad Industrial (INAPI) Chile, Office Action in Chilean Patent Application No. 201703049, dated Jun. 18, 2019, 8 pages.

* cited by examiner

WASHING MACHINE

CROSS-REFERENCE TO RELATED APPLICATIONS AND CLAIM OF PRIORITY

The present application is a continuation of International Application No. PCT/KR2016/008889 filed Aug. 12, 2016, which claims the benefit of Korean Patent Application No. 10-2015-0120875 filed Aug. 27, 2015, the disclosures of which are fully incorporated herein by reference into the present disclosure as if fully set forth herein.

TECHNICAL FIELD

The present disclosure relates to a washing machine, and more particularly, to a washing machine which has an improved insertion structure so that laundry is easily inserted into the washing machine.

BACKGROUND

Generally, a washing machine is a machine that washes clothing using electric power, and types of the washing machine include a front-loading washing machine in which a rotating tub is horizontally disposed to wash laundry by lifting the laundry along an inner circumferential surface of the rotating tub and dropping the laundry while rotating the rotating tub rotates about a horizontal axis in forward and reverse directions, and a vertical-axis clothes washing machine in which a rotating tub provided with a pulsator is vertically disposed to wash laundry using a water current generated by the pulsator while rotating the rotating tub about a vertical axis in forward and reverse directions.

Generally, the front-loading washing machine includes a cabinet, a tub configured to store washing water in the cabinet, and a drum configured to accommodate laundry and installed to be rotatable in the tub. The cabinet includes an opening, and the opening is provided to be opened or closed by a door.

When laundry, a detergent, and washing water are inserted into the drum, the drum rotates to mix the laundry with the washing water so that dirt is removed from the laundry.

In this process, the laundry is inserted into the opening provided in the cabinet, and the detergent and the washing water are supplied by a detergent supply device.

However, when a washing cycle of the front-loading washing machine starts, the door of the front-loading washing machine maintains a locked state. Therefore, to open the door during the washing process, a user needs to wait until the washing cycle is finished or stop the washing cycle and wait until a draining of the washing water is finished. Thus, the front-loading washing machine has a problem in that an additional supply of laundry or a detergent to the inside of the drum during the washing process is restricted.

SUMMARY

The present disclosure is directed to providing a washing machine which has an improved insertion structure of laundry or a detergent so that the laundry or the detergent may freely be inserted therein.

Further, the present disclosure is directed to providing a washing machine which has an improved insertion structure so that laundry or a detergent may freely be inserted therein during a washing cycle.

Furthermore, the present disclosure is directed to providing a washing machine provided so that water is not discharged to the outside from the washing machine.

One aspect of the present disclosure provides a washing machine which includes a cabinet having a first opening and having a washing space formed therein, and a door assembly provided to open and close the first opening, the door assembly includes a door body having a second opening, a door glass having a glass hole, and a guide duct configured to connect the second opening with the glass hole, and the glass hole and the guide duct are coupled by a sealing member.

The washing machine may include an auxiliary door configured to open and close the second opening.

The sealing member may include a sealing cap having one end connected with one end of the guide duct and the other end connected with the glass hole.

The sealing cap may include a coupling groove formed to be concave along a circumference of the one end of the sealing cap, and the one end of the guide duct may be inserted into and coupled to the coupling groove.

The sealing cap may include a catcher extending from the sealing cap along a circumference of the other end of the sealing cap, and the guide duct may include a catching protrusion protruding from the one end of the guide duct along an outer circumferential surface thereof to catch a catching groove.

The sealing member may include a sealing ring having a ring shape and located between the coupling groove and a coupling protrusion.

The sealing member may further include a sealing agent configured to attach the other end of the sealing cap to the door glass.

The sealing cap may further include a sealing cap contact surface which faces the door glass and to which the sealing agent is applied.

The sealing cap may include a contact rib protruding farther from an outer edge of the sealing cap contact surface than the sealing cap contact surface to prevent the sealing agent from being leaked.

The contact rib may include a first contact rib which is adjacent to the sealing cap contact surface and a second contact rib formed to be separated a predetermined distance from the first contact rib.

The sealing member may further include a rib contact ring disposed between the first contact rib and the second contact rib to seal a gap between the sealing cap and the door glass.

The door glass may include an introduction preventing protrusion formed around the sealing member and formed to protrude toward an inside of the cabinet.

Another aspect of the present disclosure provides a washing machine which includes a cabinet having a first opening and a door assembly provided to open and close the first opening, wherein the door assembly includes a door unit having a second opening and rotatably provided in the cabinet to open and close the first opening and an auxiliary door provided to open and close the second opening, and the door unit includes a door glass having a glass hole communicating with the second opening and facing an inside of the cabinet, a guide duct configured to connect the second opening with the glass hole, and a sealing member configured to seal a gap between the door glass and the guide duct.

The sealing member may include a sealing cap having one end connected with one end of the guide duct and the other end connected with the door glass adjacent to the glass hole.

The sealing cap may include a coupling groove formed to be concave along a circumference of the one end of the sealing cap, and the guide duct may include a coupling protrusion formed to be inserted into the coupling groove.

The sealing member may further include a sealing agent configured to attach the other end of the sealing cap to the door glass.

The sealing cap may include a sealing cap contact surface which is in contact with the door glass and faces the door glass and a contact rib protruding farther from an outer edge of the sealing cap contact surface than the sealing cap contact surface to prevent air and washing water from being introduced between the sealing cap contact surface and the door glass.

A user can freely insert laundry or a detergent into a washing machine by opening or closing an auxiliary door at a predetermined point in time during a washing cycle.

In addition, a method of inserting laundry or supplying a detergent can be diversified.

Further, laundry or a detergent can be additionally inserted into a washing machine even while the washing machine is being operated.

Furthermore, a cabinet can be more effectively sealed by an improved sealing structure of a door.

DETAILED DESCRIPTION

Embodiments described in this specification and configurations illustrated in drawings are only exemplary examples of the disclosure, and there may be various modifications that may substitute for the embodiments and the drawings in the specification at the time of this application's filing.

Further, the same reference number or symbols disclosed in each of the drawings of the specification denote identical components or configurations which perform substantially the same functions.

Terms used in the disclosure specification are only used to describe specific exemplary embodiments and do not limit the present disclosure. Singular forms used herein are intended to include plural forms unless explicitly indicated otherwise. It should be further understood that the terms "comprises" or "have" used in this specification specify the presence of stated features, numerals, operations, components, parts, or a combination thereof, but do not preclude the presence or addition of one or more other features, numerals, operations, components, parts, or a combination thereof.

In addition, terms including ordinal numbers such as "first," "second," and the like used herein may be used to explain various components, but the components are not limited by the terms. The terms are only used to differentiate one component from other components. For example, a first component may be referred to as a second component without departing from the scope of the present disclosure, and a second component may also be similarly referred to as a first component. The term "and/or" includes a combination of a plurality of items and any one of the plurality of items.

Hereinafter, exemplary embodiments of the present disclosure will be described in detail with reference to the accompanying drawings.

Figure 1:
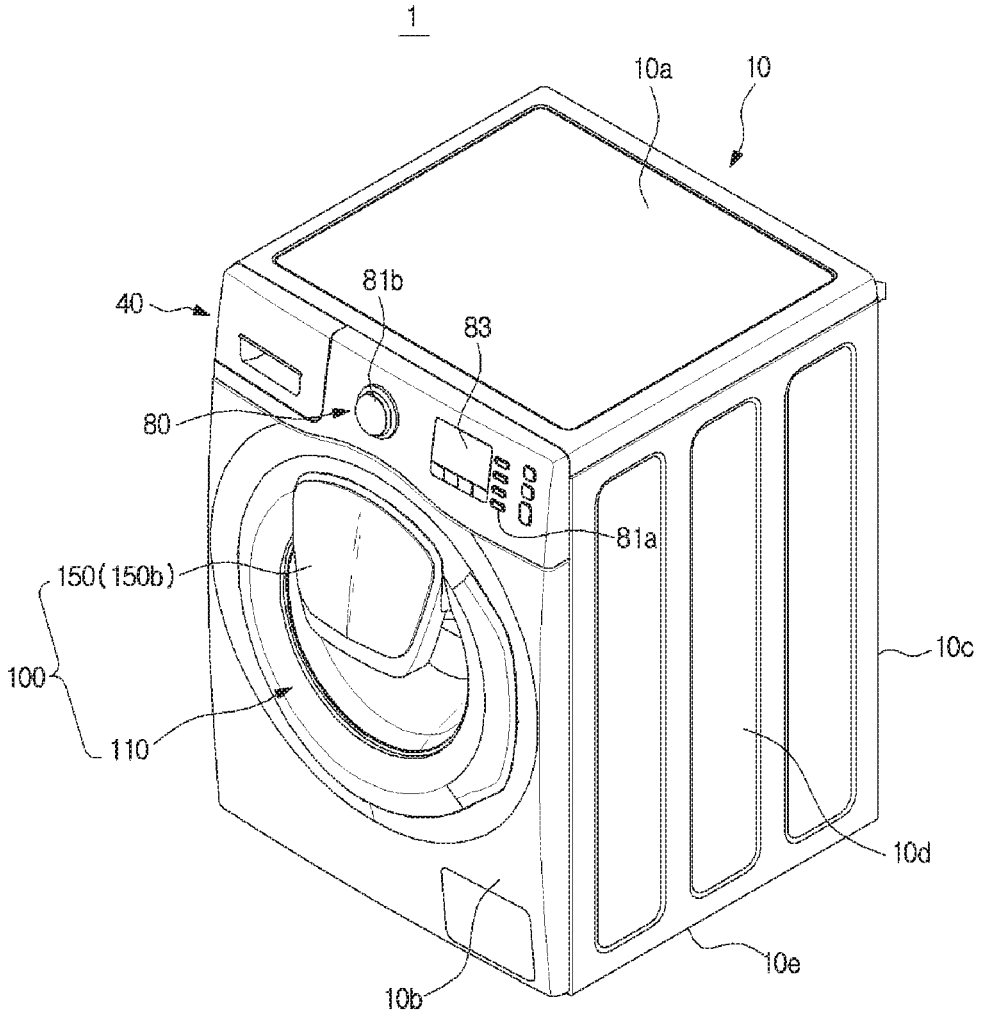
FIG. 1 is a perspective view of a washing machine according to one embodiment of the present disclosure.
Figure 2:
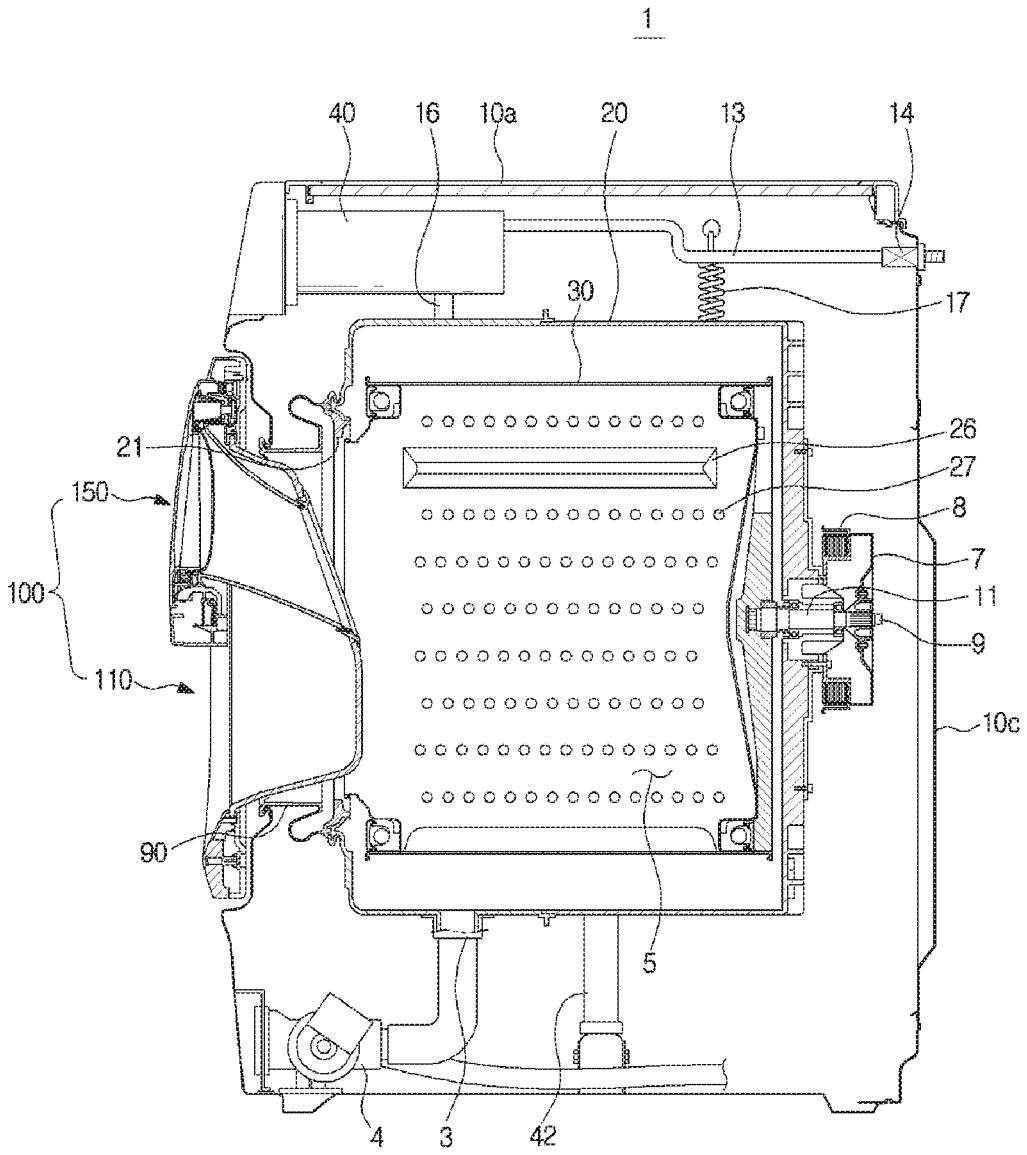
FIG. 2 is a cross-sectional view of the washing machine according to one embodiment of the present disclosure.
Figure 3:
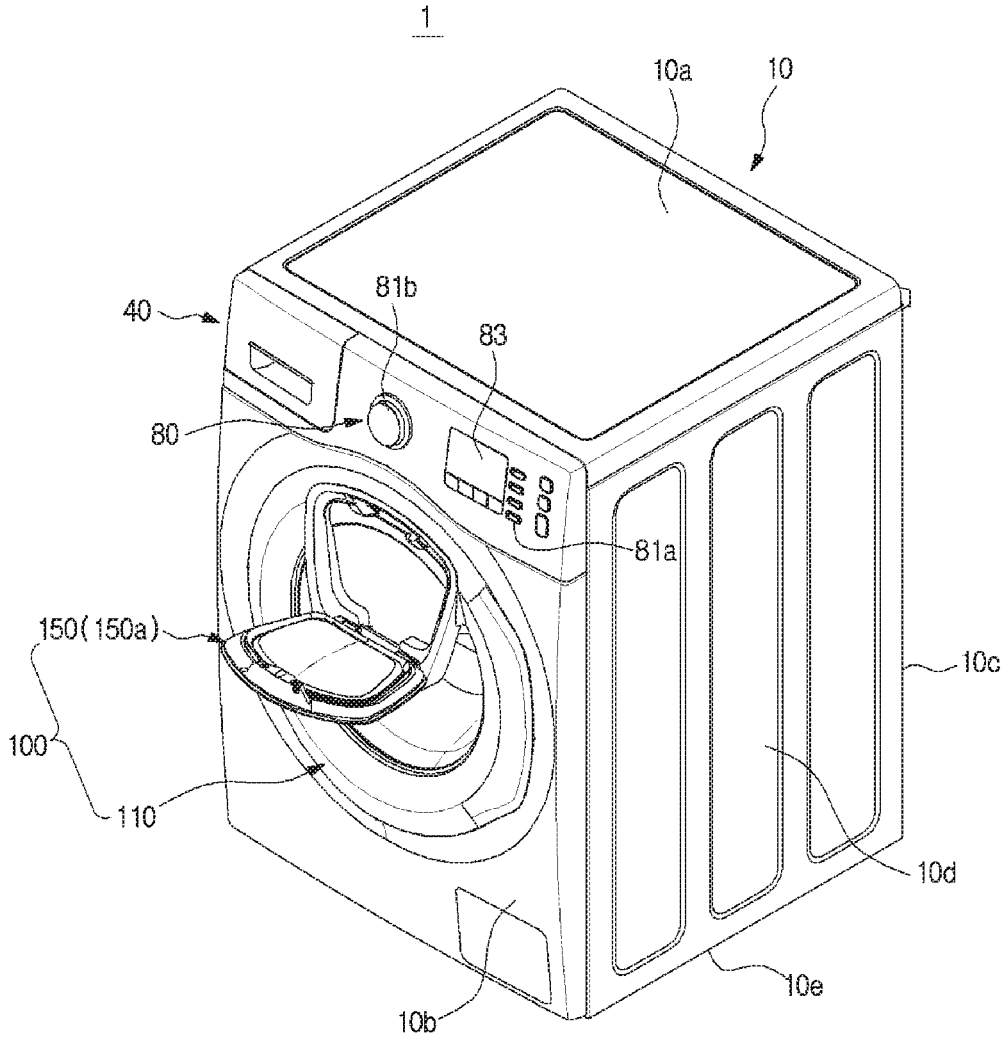
FIG. 3 is a perspective view showing a state in which an auxiliary door of the washing machine according to one embodiment of the present disclosure is open.

FIG. 1 is a perspective view of a washing machine according to one embodiment of the present disclosure, FIG. 2 is a cross-sectional view of the washing machine according to one embodiment of the present disclosure, and FIG. 3 is a perspective view showing a state in which an auxiliary door of the washing machine according to one embodiment of the present disclosure is open.

A washing machine 1 includes a cabinet 10 having a washing space 5 formed therein, a tub 20 configured to accommodate washing water or rinsing water to be used in a washing cycle or a rinsing cycle, and a driving motor 7 rotating a drum 30. The washing space 5 in the cabinet may be formed by the tub and the drum.

The cabinet 10 includes a control panel 80 having inputters 81*a* and 81*b* receiving an operational command of the washing machine 1 from a user and a display 83 displaying information on an operation of the washing machine 1.

The inputters 81*a* and 81*b* receive a command of the user related to operations of the washing machine 1, such as a washing time, the number of rinsings, a spin cycle time, a drying time, start and stop, and the like, and may include a pressing button 81*a* or a rotary button 81*b*. The display 83 also displays information on the operations of the washing machine 1, such as the amount of washing water, a cycle being performed by the washing machine 1, a remaining time until washing is completed, and the like, and may include a liquid crystal display (LED) panel, a light emitting diode (LED) panel, or the like.

The washing machine 1 according to the embodiment of the present disclosure separately includes the inputters 81*a* and 81*b* and the display 83, but is not limited thereto, and may integrally include the inputter and the display by including a torch screen panel (TSP).

The cabinet 10 includes frames 10*a*, 10*b*, 10*c*, 10*d*, and 10*e*, and the frames 10*a*, 10*b*, 10*c*, and 10*d* include an upper frame 10*a* forming an upper surface of the cabinet, a front frame 10*b* and a rear frame 10*c* forming front and rear surfaces of the cabinet 10, and a side frame 10*d* and a lower frame 10*e* connecting the front frame 10*b* with the rear frame 10*c* and forming a side surface and a lower surface of the cabinet 10.

A first opening 2*a* is formed in the front frame 10*b* of the cabinet 10 so that laundry may be inserted into the drum 30. The first opening 2*a* may be opened or closed by a door assembly 100 installed at the front frame 10*b* of the cabinet 10.

A diaphragm 90 may connect the cabinet 10 and the tub 20. Specifically, the diaphragm 90 may be disposed between the first opening 2*a* of the cabinet 10 and an opening 21 of the tub 20 corresponding to the first opening 2*a*. The diaphragm 90 forms a path from the first opening 2*a* of the cabinet 10 to the opening 21 of the tub 20 and may reduce the amount of vibration transmitted toward the front frame 10*b* when the drum 30 rotates. A part of the diaphragm 90 is disposed between the door assembly 100 and the front frame 10*b* to prevent leakage of the washing water in the tub 20 to the outside of the cabinet 10.

The diaphragm 90 may be formed as an injection molded object made of a thermoplastic elastomer. The thermoplastic elastomer has elasticity at room temperature like rubber, and thus the diaphragm 90 made of the thermoplastic elastomer may effectively reduce the amount of vibration transmitted to the front frame 10*b* of the cabinet 10 from the tub 20.

A spring 17 may be provided between the tub 20 and the cabinet 10 to support the tub 20 from the upper side of the tub 20. The spring 17 performs a function of reducing the amount of vibration and noise generated due to movement of the tub 20 caused by elasticity.

A water supply tube 13 is installed at an upper portion of tub 20 to supply washing water to the tub 20. A water supply valve 14 is installed at one side of the water supply tube 13.

A detergent supply device 40 is connected with the tub 20 by a connecting tube 16. The water supplied through the water supply tube 13 is supplied along with a detergent into the tub 20 through the detergent supply device 40.

The tub 20 is supported by dampers 42. The damper 42 connects an inner bottom surface of the cabinet 10 with an outer surface of the tub 20. The dampers 42 are located at an upper side, a left side, and a right side of the cabinet 10 except an inner bottom surface of the cabinet 10 and may support the tub 20. The damper 42 or the spring 17 may absorb vibration and an impact generated from the upper and lower sides of the tub 20 due to vertical movement of the tub 20.

The tub 20 may be supported by at least one damper 42.

A driving shaft 11 may be connected with a rear surface of the drum 30 to transmit power of the driving motor 7. A plurality of through holes 27 are formed in the perimeter of the drum 30 so that the washing water flows therethrough. A plurality of lifters 26 are installed at an inner circumferential surface of the drum 30 so that laundry is lifted or dropped when the drum 30 rotates.

The driving shaft 11 is disposed between the drum 30 and the driving motor 7. One end of the driving shaft 11 is connected to a rear plate of the drum 30, and the other end of the driving shaft 11 extends toward an outer side of a rear wall of the tub 20. When the driving motor 7 drives the driving shaft 11, the drum 30 connected to the driving shaft 11 rotates about the driving shaft 11.

A bearing housing 8 is installed at a rear wall of the tub 20 to rotatably support the driving shaft 11. The bearing housing 8 is made of an aluminum alloy and may be inserted into the rear wall of the tub 20 when the tub 20 is injection-molded. Bearings 9 are installed between the bearing housing 8 and the driving shaft 11 so that the driving shaft 11 easily rotates.

A lower portion of the tub 20 includes a drainage pump 4 for discharging water from the tub 20 to the outside of the cabinet 10, a connecting hose 3 connecting the tub 20 with the drainage pump 4 so that the water in the tub 20 is introduced into the drainage pump 4, and a drainage hose (not shown) guiding the water pumped by the drainage pump 4 to the outside of the cabinet 10.

The washing machine 1 further includes an auxiliary door to additionally insert laundry into the washing machine without opening the door. The auxiliary door will be described in detail below.

Figure 4:
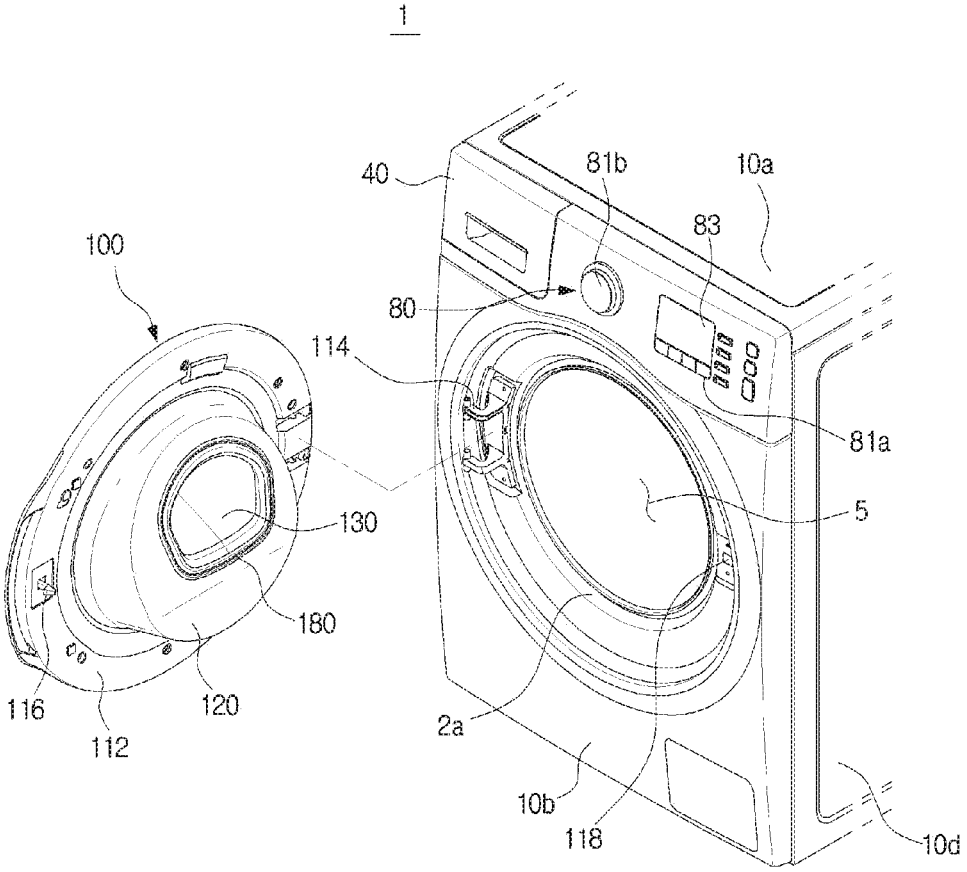
FIG. 4 is an exploded perspective view of a door assembly and a cabinet of the washing machine according to one embodiment of the present disclosure.
Figure 5:
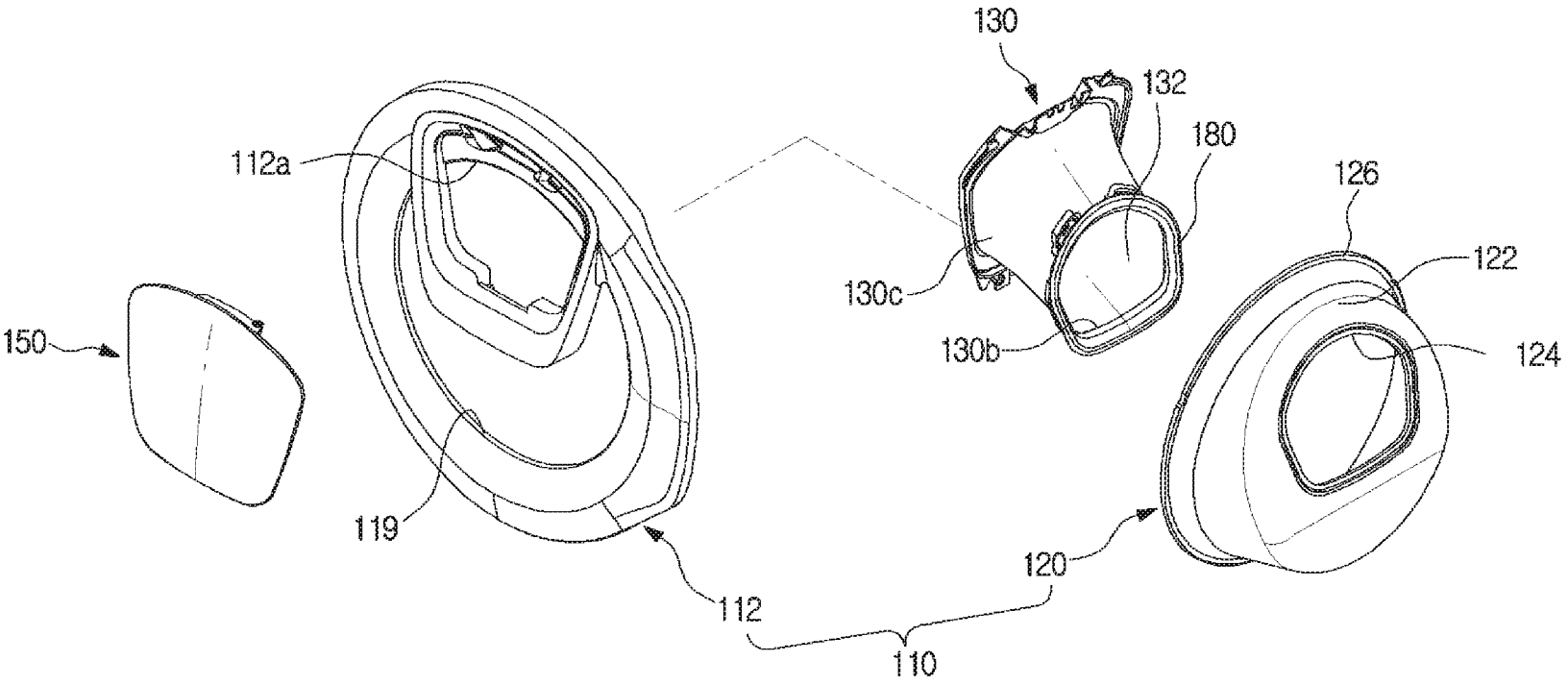
FIG. 5 is an exploded perspective view of the door assembly according to one embodiment of the present disclosure.
Figure 6:
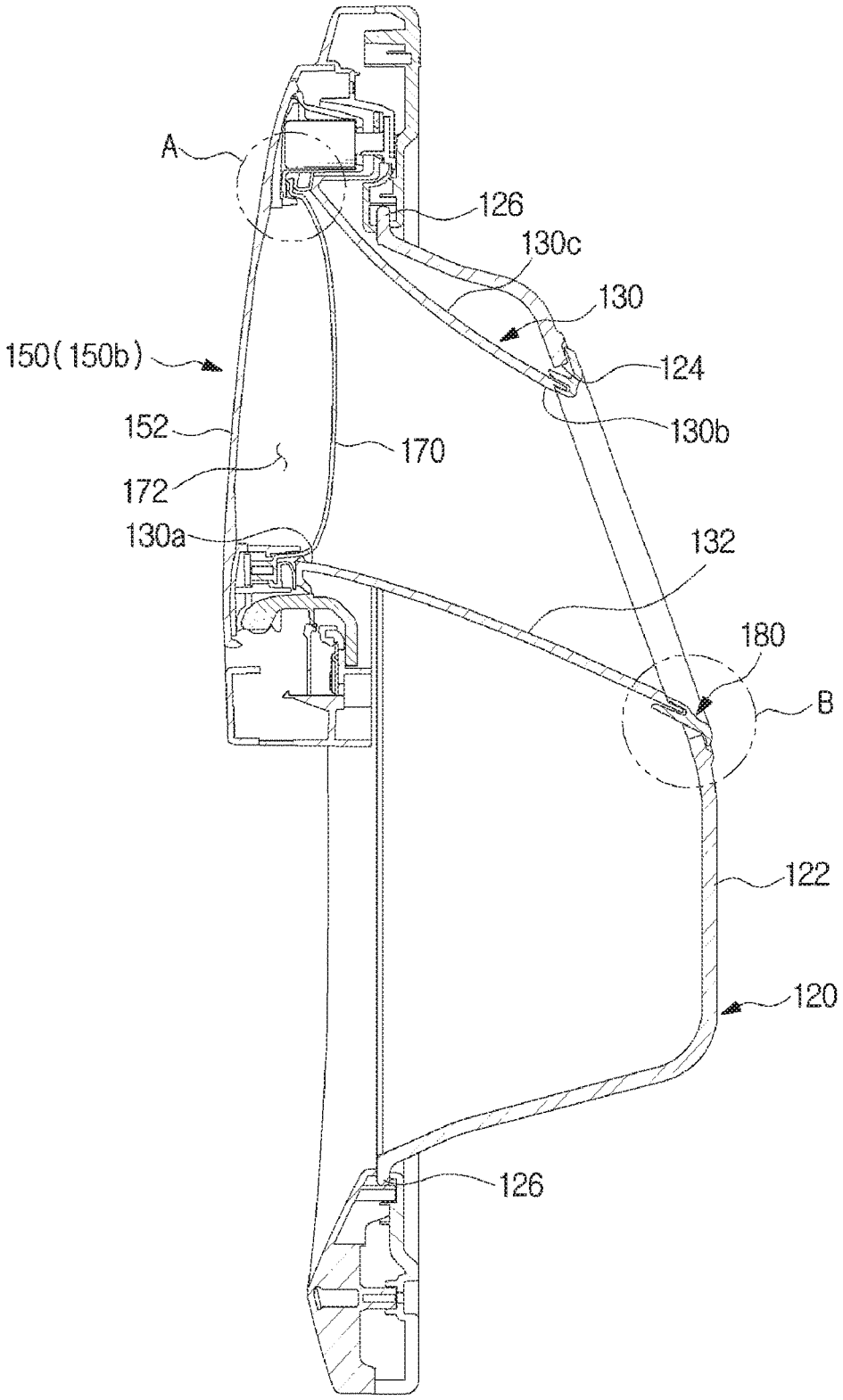
FIG. 6 is a cross-sectional view of the door assembly according to one embodiment of the present disclosure.

FIG. 4 is an exploded perspective view of the door assembly and the cabinet of the washing machine according to one embodiment of the present disclosure, FIG. 5 is an exploded perspective view of the door assembly according to one embodiment of the present disclosure, and FIG. 6 is a cross-sectional view of the door assembly according to one embodiment of the present disclosure.

The door assembly 100 is provided to open and close the first opening 2*a*.

The door assembly 100 may include a door unit 110 provided to correspond to the first opening 2*a* and an auxiliary door 150 rotatably provided at the door unit 110.

The door unit 110 may be provided to be rotatable about the cabinet 10. The door unit 110 may include a door body 112 and a door glass 120.

The door body 112 may be provided to form a frame of the door unit 110. That is, the door body 112 may be provided to correspond to a shape of the first opening 2*a*, and the door assembly 100 is provided to open and close the first opening 2*a* by rotating the door body 112 about the cabinet 10. Therefore, the door body 112 is formed to correspond to the shape of the first opening 2*a*. In the embodiment of the present disclosure, the first opening 2*a* has a nearly circular shape, and the door body 112 may also have a circular or ring shape. The first opening 2*a* has a circular shape, and the door body 112 may have a rectangular or rounded rectangular shape.

The door unit 110 may include a second opening 112*a*. The second opening 112*a* may be formed in the door body 112. However, the second opening 112*a* is not limited thereto and may be formed in the door glass 120. The second opening 112*a* may be opened or closed independently from the first opening 2*a* by the auxiliary door 150, which will be described below. Even when the first opening 2*a* is closed by the door assembly 100, the second opening 112*a* is opened by the auxiliary door 150 such that a detergent or laundry may be additionally inserted into the washing machine. That is, the second opening 112*a* may be formed to be connected with the cabinet 10 or the drum.

The door unit 110 may include the door glass 120.

The door glass 120 may be formed of a transparent material so that the inside of the drum can be seen from the outside of the washing machine even when the door assembly 100 is located at a closed position 150*b*. The door glass 120 may be disposed to protrude to be convex from the door body 112. Therefore, when the door assembly 100 is located at the closed position 150*b*, the door glass 120 protrudes farther toward the inside of the cabinet 10 than the first opening 2*a* to prevent laundry from escaping to the outside of the drum when the drum rotates. The term "door glass" refers to a transparent window installed on the door, and the term "glass" is not intended to limit a material used therefor.

The door assembly 100 may include a door rotator 114 and a door locker 116.

The door rotator 114 is provided to rotate the door body 112 about the cabinet 10. The door rotator 114 is coupled to one side of the door body 112, and the door body 112 rotates about the cabinet 10 to open a close the first opening 2*a*.

The door locker 116 is coupled to the other side of the door body 112 and is provided to maintain a closed state when the first opening 2*a* is closed by the door body 112. The cabinet 10 includes an insertion part 118 corresponding to the door locker 116 such that the door locker 116 is inserted thereinto when the first opening 2*a* is closed by the door body 112.

The auxiliary door 150 may be provided to open and close the second opening 112*a*. The auxiliary door 150 is provided to rotate about the door body 112 and is provided to open and close the second opening 112*a*.

The auxiliary door 150 is formed to have the same width as that of the second opening 112*a* or a width wider than that of the second opening 112*a*, and is provided to stably close the second opening 112*a*.

The door body 112 may include a door hole 119 corresponding to the door glass 120. The door hole 119 may have the form of an opening so that the inside of the drum can be seen through the door glass 120 disposed at a rear side of the door body 112. The door hole 119 may be disposed under the second opening 112*a*. However, the disposition of the door hole 119 is not limited, and one example of the door hole 119 may be disposed above the second opening 112*a*. Further, a transparent cover (not shown) may be provided on the door hole 119.

The door glass 120 is provided so that the inside of the drum is visible even though the first opening 2*a* is closed by the door assembly 100. The door glass 120 may include a glass body 122 convexly formed to protrude farther rearward than the door body 112. At least a part of the glass body 122 is made of a transparent glass so that the inside of the cabinet 10 is visible. However, materials of the glass body 122 and the door glass 120 are not limited. For example, at least a part of the door glass 120 may be made of a transparent material so that the inside of the cabinet 10 is visible from the outside of the cabinet 10.

The door glass 120 may include a glass hole 124. The glass hole 124 is provided to communicate with the inside of the washing space 5 in the cabinet 10. Therefore, the detergent or laundry introduced through the second opening 112*a* may be introduced into the cabinet 10 through the glass hole 124. The shape of the glass hole 124 is not limited. The second opening 112*a* is located at one side 130*a* of a guide duct 130, which will be described below, and the glass hole 124 is located at the other side 130*b* of the guide duct 130.

The door glass 120 may further include a glass flange 126 provided at an end of the glass body 122 in a flange shape to be mounted on the door body 112 or to be coupled to the door body 112. The glass flange 126 is mounted on or coupled to the door body 112 to prevent the door glass 120 form escaping from the door body 112.

The door unit 110 may include the guide duct 130. The guide duct 130 has both open ends and may have a shape of a pipe with a hollow portion. Specifically, the guide duct 130 may be provided to have the one side 130*a* connected with the second opening 112*a* and the other side 130*b* connected with the glass hole 124. The auxiliary door 150 may seal the one side 130*a* of the guide duct 130.

The guide duct 130 has a tubular shape, and thus a detergent or laundry introduced from the one side 130*a* of the guide duct 130 through the second opening 112*a* passes through a body 130*c* of the guide duct 130 to be introduced into the drum through the glass hole 124 from the other side 130*b* of the guide duct 130.

An inner circumferential surface of the guide duct 130 may be defined as a duct inner surface 132. That is, the duct inner surface 132 forms a space between the second opening 112*a* and the glass hole 124 and is provided so that the laundry or detergent introduced into the second opening 112*a* is guided into the drum through the glass hole 124.

The shape of the duct inner surface 132 is not limited. In the embodiment of the present disclosure, the duct inner surface 132 may be provided to be inclined from the front side toward the rear side. That is, the one side 130*a* of the guide duct 130 connected with the second opening 112*a* may be formed to be at a higher level than the other side 130*b* of the guide duct 130 connected with the glass hole 124. Thus, the laundry or the detergent inserted through the second opening 112*a* may be easily inserted into the drum.

Hereinafter, the auxiliary door 150 according to the embodiment of the present disclosure will be described.

The auxiliary door 150 is provided to move between an opened position 150*a* (see FIG. 3) at which the second opening 112*a* is open and the closed position 150*b* (see FIG. 1) at which the second opening 112*a* is closed.

The auxiliary door 150 may include an auxiliary door body 152 and an inner door 170 provided in the auxiliary door body 152. The auxiliary door body 152 may be referred to as an outer door.

The auxiliary door 150 may be formed of a heat-insulating or heat-resistant material. When the washing machine 1 performs a drying function, heat in the cabinet 10 is transmitted to the auxiliary door 150 and increases a temperature of the auxiliary door 150. When a user comes into contact with the heated auxiliary door 150, the user may feel displeasure, and thus the auxiliary door 150 may be formed of a heat-insulating material to prevent the displeasure. Thus, transmission of heat of air flowing in the washing space 5 in the auxiliary door 150 to the outside of the auxiliary door 150 may be prevented.

The auxiliary door body 152 is provided to form an appearance of the auxiliary door 150 and may be disposed in front of the inner door 170. The auxiliary door body 152 may include a locking unit provided on the door body 112 to be selectively locked. Hereinafter, the locking unit will be described in detail.

A hinge unit 160 may be provided between the auxiliary door body 152 and the door body 112 so that the auxiliary door 150 moves between the opened position 150*a* and the closed position 150*b*. Hereinafter, the hinge unit 160 will be described in detail.

Figure 7:
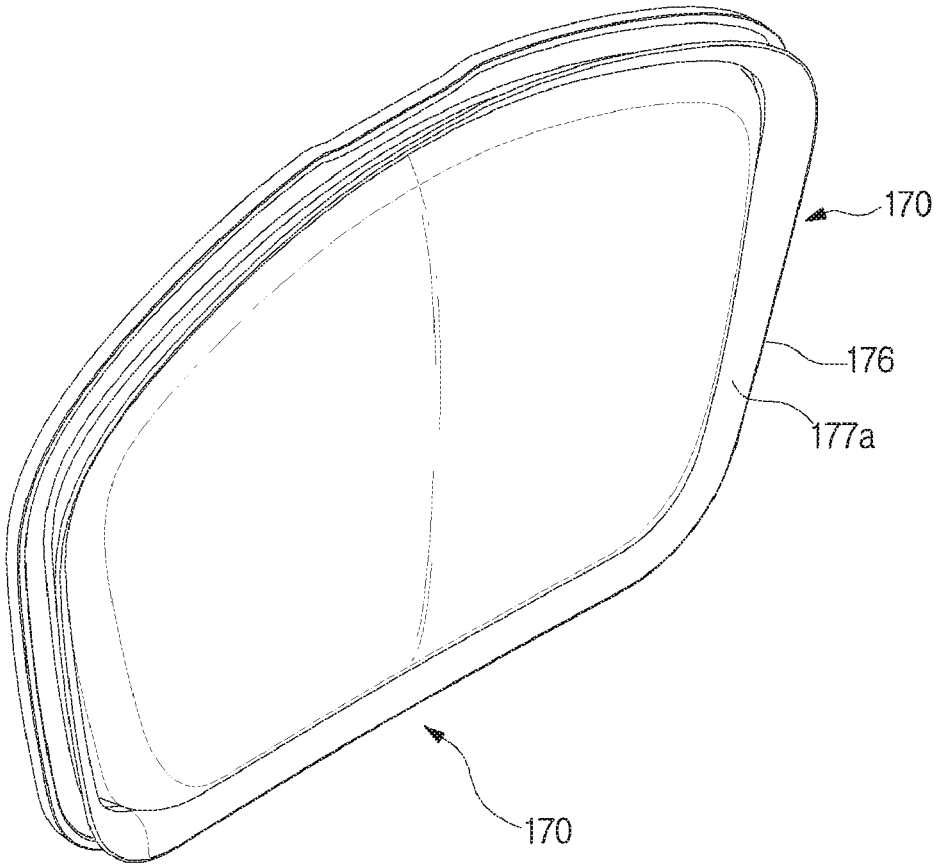
FIG. 7 is a perspective view of an inner door according to one embodiment of the present disclosure.

FIG. 7 is a perspective view of an inner door according to one embodiment of the present disclosure, which will be described with reference to FIG. 7 and the preceding drawings.

The inner door 170 may be disposed behind the auxiliary door body 152. The inner door 170 is formed to correspond to the second opening 112*a* and may be provided to seal the second opening 112*a* when the auxiliary door 150 is located at the closed position 150*b*.

An insulating space 172 is provided between the auxiliary door body 152 and the inner door 170. The insulating space 172 is disposed between the inner door 170 and the auxiliary door body 152 to prevent transmission of heat from the washing machine to the outside through the second opening 112*a* when the auxiliary door 150 is located at the closed position 150*b*. The inner door 170 is formed to be exposed to the washing space 5 in the cabinet 10, and thus the inner door 170 may be provided to have better heat-insulating or heat-resisting performance than the auxiliary door body 152.

The insulating space 172 may be formed with an air layer. The air layer in the insulating space 172 may prevent heat between the inner door 170 and the auxiliary door body 152 from being easily transmitted.

The inner door 170 may be formed to be convex toward the inner side of the guide duct 130. That is, the inner door 170 is formed to correspond to the second opening 112*a* and may be provided to have a shape convex from the one side 130*a* of the guide duct 130 corresponding to the second opening 112*a* toward the other side 130*b* of the guide duct 130 corresponding to the glass hole 124. The shape ensures that the insulating space 172 is wide and may prevent heat flowing to the guide duct 130 from the inside of the washing machine 1 from being transmitted to the outside of the auxiliary door 150.

Further, the convex shape of the inner door 170 may disturb heat transmission to the inner door 170 by disturbing a flow of air in the guide duct 130.

Figure 8:
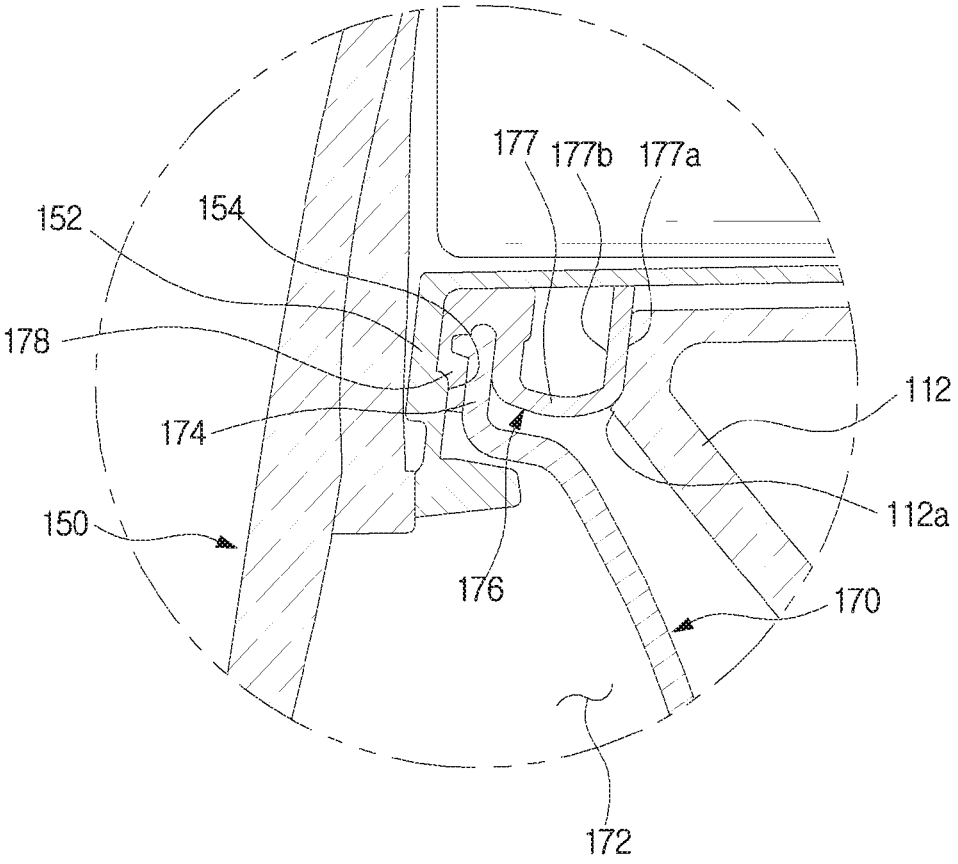
FIG. 8 is an enlarged view of portion A of FIG. 6.

FIG. 8 is an enlarged view of portion A of FIG. 6.

The inner door 170 may include a door coupling flange 174. The auxiliary door body 152 may have the coupling surface 154 corresponding to the door coupling flange 174. The door coupling flange 174 is in contact with a coupling surface 154 and is screw-coupled thereto through a fastening hole formed in the door coupling flange 174, and thus the auxiliary door body 152 and the inner door 170 are coupled to each other. The above description is an example of coupling the inner door 170 and the auxiliary door body 152, but the coupling is not limited thereto. As another example of coupling the inner door 170 and the auxiliary door body 152, the inner door 170 and the auxiliary door body 152 may be integrally formed. As a still another example, the inner door 170 and the auxiliary door body 152 may be coupled by insertion-coupling.

The inner door 170 may include a flange sealer 176. The flange sealer 176 is formed around the inner door 170 and is provided so that the inner door 170 is attached to the second opening 112*a*.

The flange sealer 176 may be disposed in front of the door coupling flange 174. The flange sealer 176 may be located at a coupling portion of the auxiliary door body 152 and the inner door 170. The flange sealer 176 is provided so that washing water or air is not leaked from the washing machine 1 through a gap which may be formed between the auxiliary door body 152 and the inner door 170. The flange sealer 176 may be made of an elastic material. Thus, when the auxiliary door 150 is located at the closed position 150*b*, the flange sealer 176 may prevent a gap between the auxiliary door 150 and the second opening 112*a*.

The flange sealer 176 may include a sealer body 177 and a sealing coupler 178 extending from the sealer body 177. The sealing coupler 178 may be provided to be located between the door coupling flange 174 of the inner door 170 and the coupling surface 154 of the auxiliary door body 152. That is, the sealing coupler 178 may be provided between the door coupling flange 174 and the coupling surface 154 to be fixed to the door coupling flange 174 and the coupling surface 154. The sealing coupler 178 is disposed along the coupling portion of the auxiliary door body 152 and the inner door 170 to seal a gap between the auxiliary door body 152 and the inner door 170.

The flange sealer 176 may be provided to be flexible. The sealer body 177 may include first sealing surface 177*a* formed to be convex toward the second opening 112*a* and a second sealing surface 177*b* formed to be concave from another side of the first sealing surface 177*a* toward the second opening 112*a*. When the second opening 112*a* is closed by the auxiliary door 150, the first sealing surface 177*a* is in contact with the second opening 112*a*, and the flange sealer 176 is curved, and thus a gap between the second opening 112*a* and the auxiliary door 150 is filled.

Figure 9:
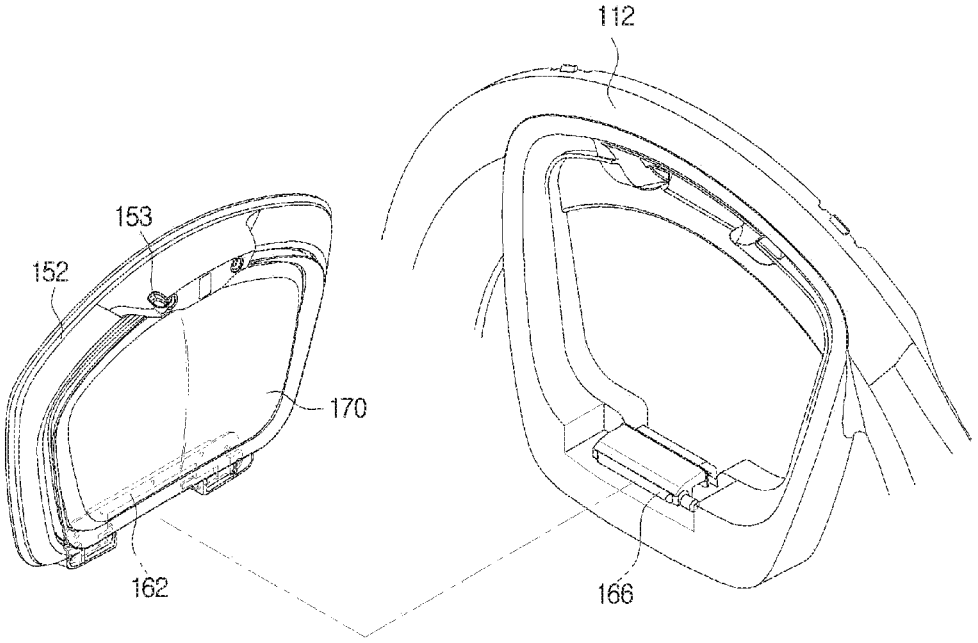
FIG. 9 is an exploded view of the auxiliary door and a door unit of the door assembly according to one embodiment of the present disclosure.
Figure 10:
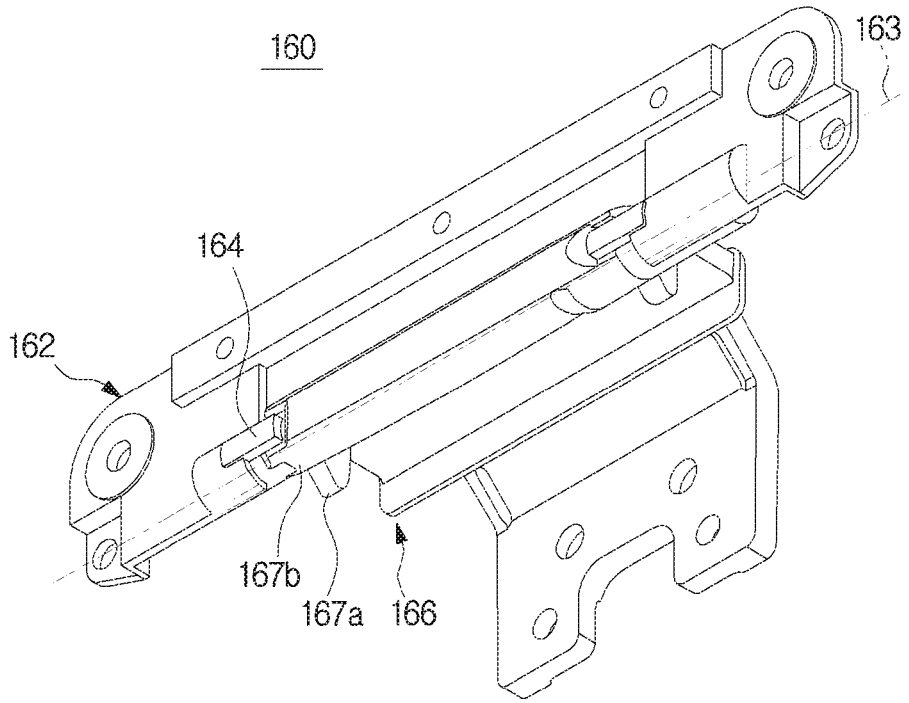
FIG. 10 is a perspective view of a hinge unit according to one embodiment of the present disclosure.
Figure 11:
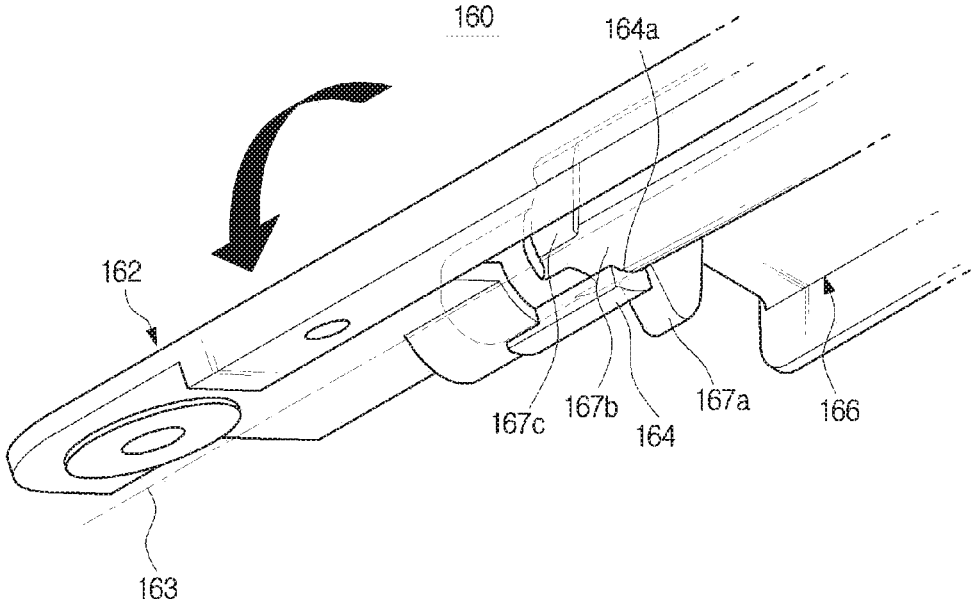
FIG. 11 is a view showing an operation of the hinge unit according to one embodiment of the present disclosure.

FIG. 9 is an exploded view of the auxiliary door and the door unit of the door assembly according to one embodiment of the present disclosure, FIG. 10 is a perspective view of the hinge unit according to one embodiment of the present disclosure, and FIG. 11 is a view showing an operation of the hinge unit according to one embodiment of the present disclosure.

The door assembly 100 may include the hinge unit 160.

The hinge unit 160 is provided to move the auxiliary door 150 between the opened position 150*a* at which the second opening 112*a* is opened by the auxiliary door 150 and the closed position 150*b* at which the second opening 112*a* is closed by the auxiliary door 150 by rotating the auxiliary door 150 from the door body 112.

The hinge unit 160 may include a rotator 162 and a rotation guider 166.

The rotator 162 may be provided at the auxiliary door 150, and the rotation guider 166 may be provided at the door body 112. However, locations of the rotator 162 and the guider 166 are not limited thereto, and the rotator 162 may be provided at the door body 112 while the rotation guider 166 may be provided at the auxiliary door 150.

The rotator 162 is provided to rotate along with the auxiliary door 150. The rotator 162 has a fastening hole to be coupled to the auxiliary door 150, and may be screw-coupled to the auxiliary door 150.

The rotator 162 may include a rotation protrusion (not shown). The rotation protrusion is rotatably inserted into a rotation groove shown) formed on the rotation guider 166, and the rotator 162 may have a rotation axis 163 formed on the rotation guider 166 and be provided to rotate about the rotation axis 163. Conversely, the rotator 162 may have the rotation groove, and the rotation guider 166 may have the rotation protrusion.

The rotator 162 may include a guide protrusion 164 moving on a mount surface 167*c*, a guide surface 167*b*, and a stopper 167*a* of the rotation guider 166, which will be described below. The guide protrusion 164 moves along the rotation guider 166 to guide or limit an operation of the auxiliary door 150. The guide protrusion 164 may be disposed to be adjacent to the rotation protrusion (not shown).

The guide protrusion 164 may include a guide contact surface 164*a* having a curved surface facing the rotation guider 166.

The rotation guider 166 may include surface 167*c*, the guide surface 167*b*, and the stopper 167*a*.

The mount surface 167*c* is provided so that the guide protrusion 164 is located thereon when the auxiliary door 150 is located at the closed position 150*b*. The mount surface 167*c* may be formed to be flat, and the guide contact surface 164*a* of the guide protrusion 164 may be mounted on the mount surface 167*c*. Thus, when the auxiliary door 150 is located at the closed position 150*b*, a state of the auxiliary door 150 may be stably maintained.

The guide surface 167*b* is provided to guide the movement of the guide protrusion 164 when the auxiliary door 150 moves between the closed position 150*b* and the opened position 150*a*, The guide surface 167*b* may be formed to be curved, and the guide contact surface 164*a* of the guide protrusion 164 may be in contact with the guide surface 167*b*. The guide surface 167*b* may extend from the mount surface 167*c* and may be formed between the stopper 167*a* and the mount surface 167*c*. Thus, when the auxiliary door 150 moves between the closed position 150*b* and the opened position 150*a*, the movement of the auxiliary door 150 may be guided.

The stopper 167*a* is provided to limit the movement of the guide protrusion 164 when the auxiliary door 150 is located at the opened position 150*a*. The stopper 167*a* may be formed to protrude from the guide surface 167*b* and is provided so that the guide protrusion 164 is caught thereon to limit the movement of the guide protrusion 164. Thus, the auxiliary door 150 is not excessively pulled at the opened position 150*a*, and the auxiliary door body 152 can be prevented from being damaged due to coming into contact with the door body 112.

Figure 12:
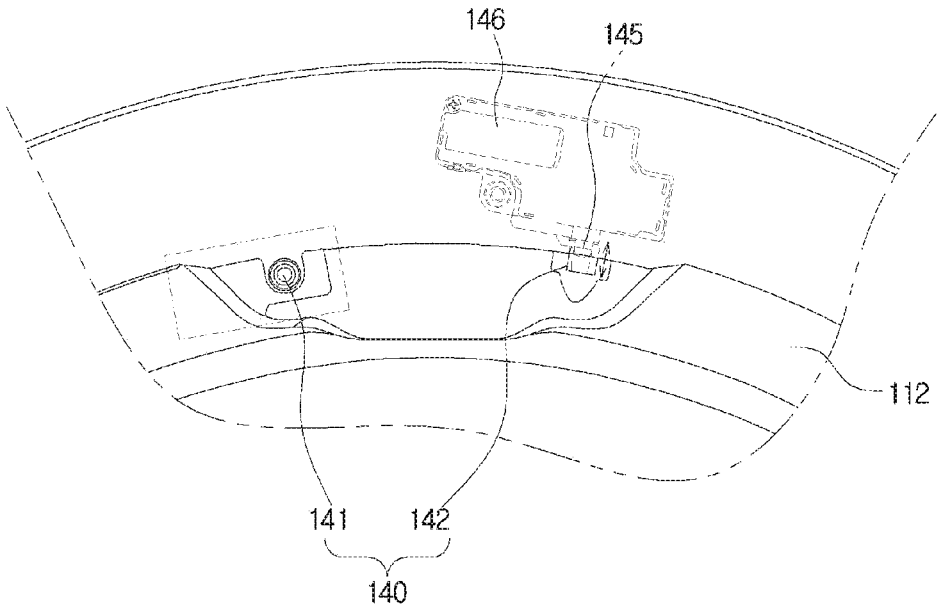
FIG. 12 is a view showing a locking unit and a sensor assembly of the auxiliary door according to e embodiment of the present disclosure.

FIG. 12 is a view showing a locking unit and a sensor assembly of the auxiliary door according to one embodiment of the present disclosure.

The door unit 110 may include a sensor assembly 140 detecting the opened position 150*a* and the closed position 150*b* of the auxiliary door 150, and a locking unit.

The sensor assembly 140 is provided to detect the opened position 150*a* or the closed position 150*b* of the auxiliary door 150. The sensor assembly 140 may include at least one sensor.

In the embodiment of the present disclosure, the sensor assembly 140 may include a first sensor 141 and a second sensor 142.

The first sensor 141 is provided to protrude when the auxiliary door 150 is located at the opened position 150*a*, and is provided to be pressed by the auxiliary door body 152 when the auxiliary door 150 moves from the opened position 150*a* to the closed position 150*b*.

The second sensor 142 is provided to protrude in front of the auxiliary door body 152 when the auxiliary door 150 is located at the opened position 150*a*, and is provided to be pressed by the auxiliary door body 152 to rotate and be inserted into the auxiliary door body 152 when the auxiliary door 150 moves from the opened position 150*a* to the closed position 150*b*.

The first sensor 141 and the second sensor 142 are an example of the sensor assembly 140, but the sensor assembly 140 is not limited thereto. That is, at least one sensor may be provided to detect the closed position 150*b* of the auxiliary door 150.

The locking unit may lock the auxiliary door 150 at the closed position 150*b*. The locking unit may be operated by allowing the sensor assembly 140 to detect the position of the auxiliary door 150. The locking unit may include a locking protrusion 145 provided to be inserted into a locking groove 153 formed on the auxiliary door 150, and a locking controller 146 driving the locking protrusion 145. The locking controller 146 controls an operation of the locking protrusion 145 through a signal of the closed position 150*b* of the auxiliary door 150 detected by the first sensor 141 and the second sensor 142 of the sensor assembly 140.

The first sensor 141 and the second sensor 142 are normally operated to detect whether the auxiliary door 150 is positioned at the closed position 150*b*, and the locking unit may forcibly perform locking to prevent the auxiliary door 150 from escaping from the closed position 150*b* by inserting the locking protrusion 145 into the locking groove 153 during a predetermined process of a washing or spinning process.

The locking controller may forcibly lock the auxiliary door 150 only when both of the first sensor 141 and the second sensor 142 are normally operated to detect whether the auxiliary door 150 is positioned at the closed position 150*b*.

That is, the auxiliary door 150 may not be unlocked even when any one of the first sensor 141 and the second sensor 142 malfunctions.

Figure 13:
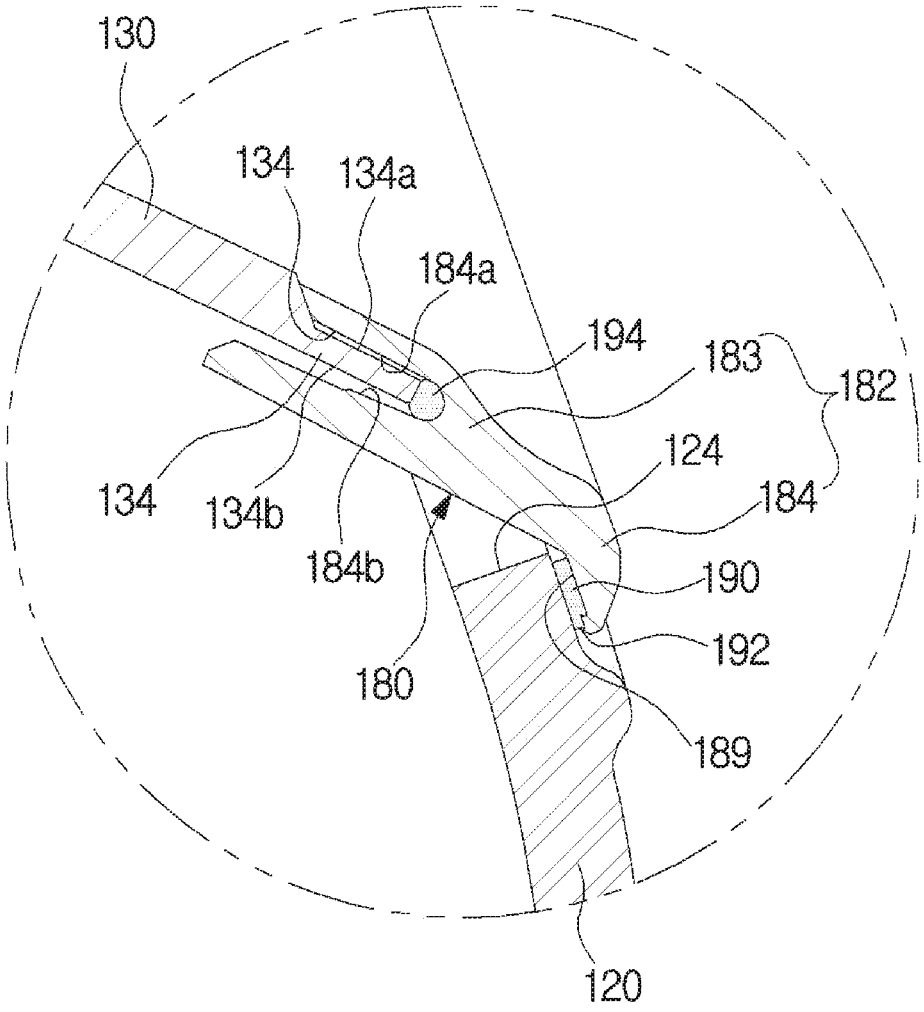
FIG. 13 is an enlarged view of portion B of FIG. 6.
Figure 14:
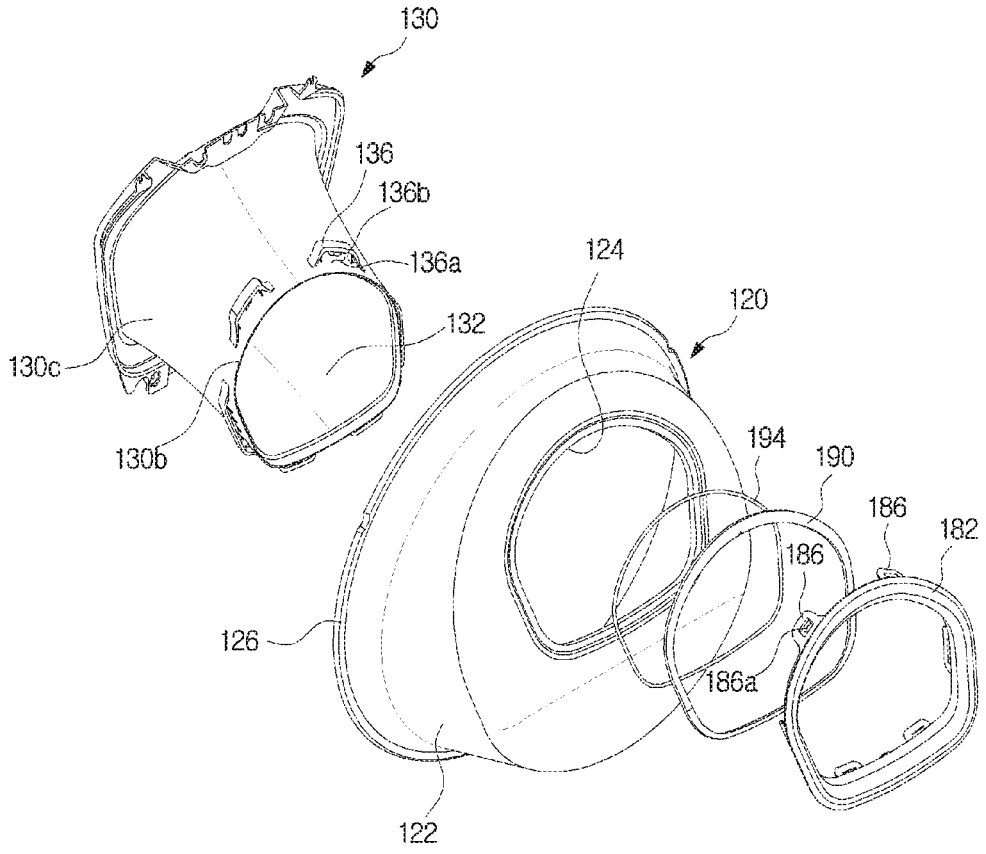
FIG. 14 is an exploded perspective view of components adjacent to a sealing unit according to one embodiment of the present disclosure.

FIG. 13 is an enlarged view of portion B of FIG. 6, and FIG. 14 is an exploded view of components adjacent to a sealing unit according to one embodiment of the present disclosure.

The door unit 110 may include a sealing member 180.

The sealing member 180 is provided to seal a gap between the other end of the guide duct 130 and a glass hole of the door glass 120. The door glass 120 and the guide duct 130 are directly exposed to the inside of the cabinet 10, and thus a sealing component for sealing the gap between the door glass 120 and the guide duct 130 is required. The sealing member 180 seals the gap between the guide duct 130 and the door glass 120 to prevent washing water or air from escaping from the cabinet 10.

The sealing member 180 may include a sealing cap 182.

The sealing cap 182 has one end connected with the guide duct 130 and the other end connected with the door glass 120 which is adjacent to the glass hole 124. That is, the sealing cap 182 is disposed between the guide duct 130 and the door glass 120 and connects and seals both of the guide duct 130 and the door glass 120. One end of the guide duct 130 and the glass hole 124 has an opening shape, and thus the sealing cap 182 may have a ring shape to correspond to the glass hole 124.

The sealing cap 182 may include a first cap 183 connected with the guide duct 130 and a second cap 188 connected with the glass hole 124. The first cap 183 and the second cap 188 may be integrally formed. The guide duct 130 and the door glass 120 are configured to meet each other at varying angles along a circumference thereof, and thus the first cap 183 and the second cap 188 may be provided to correspond to the guide duct 130 and the door glass 120 so that the guide duct 130 and the door glass 120 meet each other at varying angles along a circumference thereof.

One end of the sealing cap 182 may include a coupling groove 184 formed to be concave along a circumference thereof. The coupling groove 184 may be formed at an end of the first cap 183. The guide duct 130 may include a coupling protrusion 134 to be inserted into the coupling groove 184. The coupling protrusion 134 is inserted into the coupling groove 184, and the sealing cap 182 may be coupled to the guide duct 130.

Thus, an inner circumferential surface 134*a* and an outer circumferential surface 134*b* of the coupling protrusion 134 of the guide duct 130 are in contact with an inner surface of the coupling groove 184 to seal a gap between the sealing cap 182 and the guide duct 130.

The sealing member 180 may further include a sealing ring 194 having a ring shape and located between the coupling groove 184 and the coupling protrusion 134. The sealing ring 194 may be inserted into the coupling groove 184 to be located at an end of the coupling protrusion 134 when the coupling protrusion 134 is inserted into the coupling groove 184. A cross-section of the sealing ring 194 is formed in a circular shape in the embodiment of the present disclosure, but the shape of the cross-section of the sealing ring 194 is not limited. Of course, the cross-section of the sealing ring 194 may have another shape depending on shapes of the coupling protrusion 134 and the coupling groove 184.

Therefore, a sealing structure formed with the inner circumferential surface 134*a* of the coupling protrusion 134 and the inner surface of the coupling groove 184, and the outer circumferential surface 134*b* of the coupling protrusion 134 and the inner surface of the coupling groove 184 may stably seal the gap between the guide duct 130 and the sealing cap 182.

The sealing cap 182 may include a catcher 186 formed along a circumference of one end of the sealing cap 182. The catcher 186 extends and protrudes from the sealing cap 182, and the catcher 186 may have a catching groove 186*a* having a hole shape. At least one catcher 186 may be disposed along a circumference of the first cap 183.

The guide duct 130 may include a catching guide 136. The catching guide 136 may be formed on the outer circumferential surface 134*b* of the one end of the guide duct 130 and extend from the guide duct 130. The catching guide 136 may be integrated with the guide duct 130.

The catching guide 136 has an insertion hole 136*a* into which the catcher 186 may be inserted, and may include a catching protrusion 136*b* formed therein to correspond to the catching groove 186*a*. Thus, the catcher 186 is inserted into the insertion hole 136*a*, and the catching protrusion 136*b* is caught on the catching groove 186*a*, and thus the sealing cap 182 and the guide duct 130 may be coupled to each other.

The numbers of the catcher 186 and the catching guide 136 are not limited, and six catchers 186 and catching guides 136 are provided as an example in the embodiment of the present disclosure. The sealing cap 182 and the guide duct 130 are coupled so that the catching groove 186*a* of the sealing cap 182 is caught on the catching protrusion 136*b* of the guide duct 130, and thus the sealing cap 182 and the guide duct 130 may be prevented from escaping from each other.

The sealing cap 182 may include a sealing cap contact surface 189 provided to face the door glass 120 which is adjacent to the glass hole 124 along a circumference of the other end of the sealing cap 182. The sealing cap contact surface 189 may be provided to be in contact with the door glass 120 and may seal a gap between the sealing cap contact surface 189 and the door glass 120 through a surface contact.

The sealing member 180 may further include a sealing agent 190 applied to the sealing cap contact surface 189 so that the sealing cap 182 adheres to the door glass 120. The type of the sealing agent 190 is not limited, and urethane may be applied to the sealing agent 190 as an example.

The sealing member 180 may include a contact rib 192 protruding farther from an outer edge of the sealing cap contact surface 189 than the sealing cap contact surface 189. The contact rib 192 is formed to be in contact with the door glass 120 when the door glass 120 and the sealing cap 182 are coupled and prevents the sealing agent 190 applied to the sealing cap contact surface 189 from being leaked to the outside of the sealing cap 182. Further, the contact rib 192 is formed to be in contact with the door glass 120 to allow the sealing cap 182 and the door glass 120 to be stably attached to each other.

The door glass 120 may include an introduction preventing protrusion 138 formed to be adjacent to the glass hole 124. The introduction preventing protrusion 138 is formed along the sealing member 180 and is formed to protrude toward the inside of the cabinet 10. The introduction preventing protrusion 138 is formed to be adjacent to a coupling position between the sealing member 180 and the door glass 120 to prevent air or washing water which moves along a surface of the door glass 120 or moves in the cabinet 10 from being directly introduced into the coupling portion between the sealing member 180 and the door glass 120.

Hereinafter, a washing machine according to another embodiment of the present disclosure will be described.

Descriptions of configurations already described above will be omitted.

Figure 15:
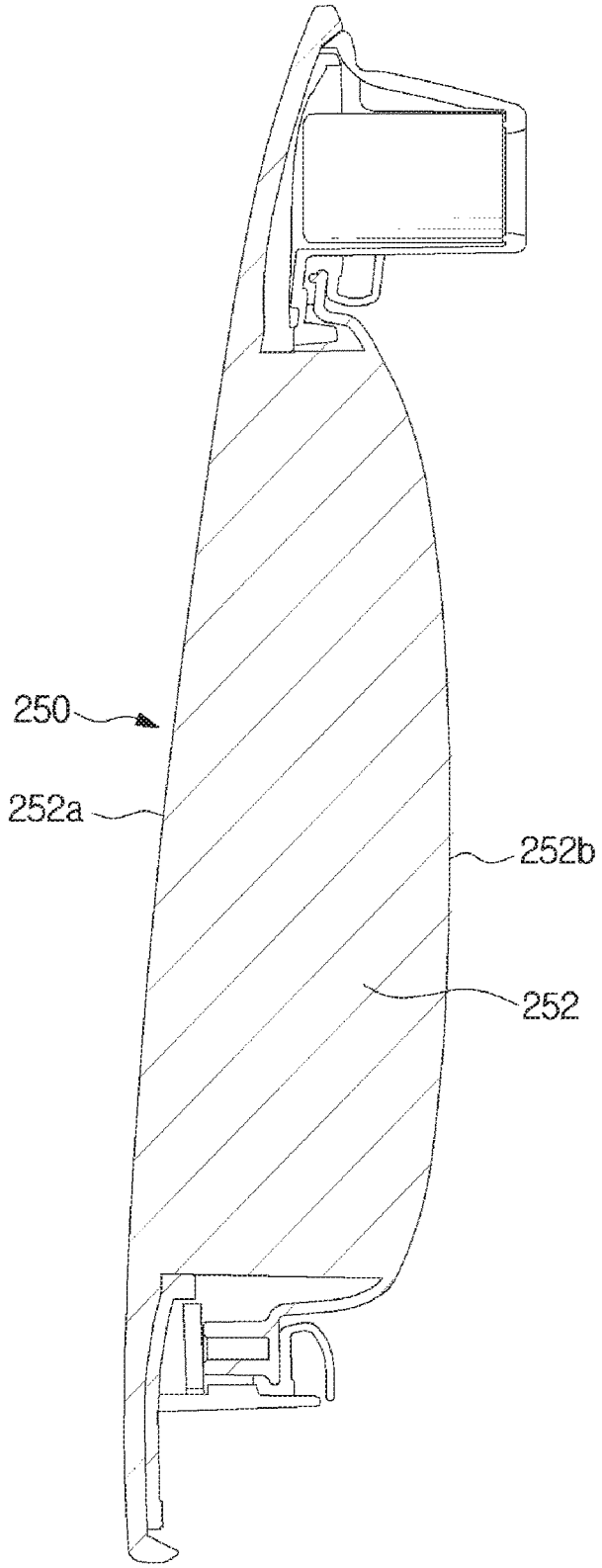
FIG. 15 is a cross-sectional view of an auxiliary door according to another embodiment of the present disclosure.

FIG. 15 is a cross-sectional view of an auxiliary door according to another embodiment of the present disclosure.

An auxiliary door 250 is provided to rotate from a door unit 110 to open and close a second opening 112*a*.

The auxiliary door 250 may include an auxiliary door body 252 corresponding to the second opening 112*a*.

The auxiliary door body 252 may include an outer surface 252*a* forming an appearance and an inner surface 252*b* formed to be convex from one side 130*a* of a guide duct 130 toward the other side 130*b* thereof. That is, the inner surface 252*b* may be provided to have a convex shape from the one side 130*a* of the guide duct 130 toward the other side 130*b* of the guide duct 130 corresponding to a glass hole 124.

The auxiliary door body 252 may be formed of a heat-insulating or heat-resisting material. Therefore, heat of air moving in a washing space 5 in the auxiliary door body 252 may not be transmitted to the outside of the auxiliary door 250.

Hereinafter, a washing machine according to still another embodiment of the disclosure will be described.

Descriptions of the components already described above will be omitted.

Figure 16:
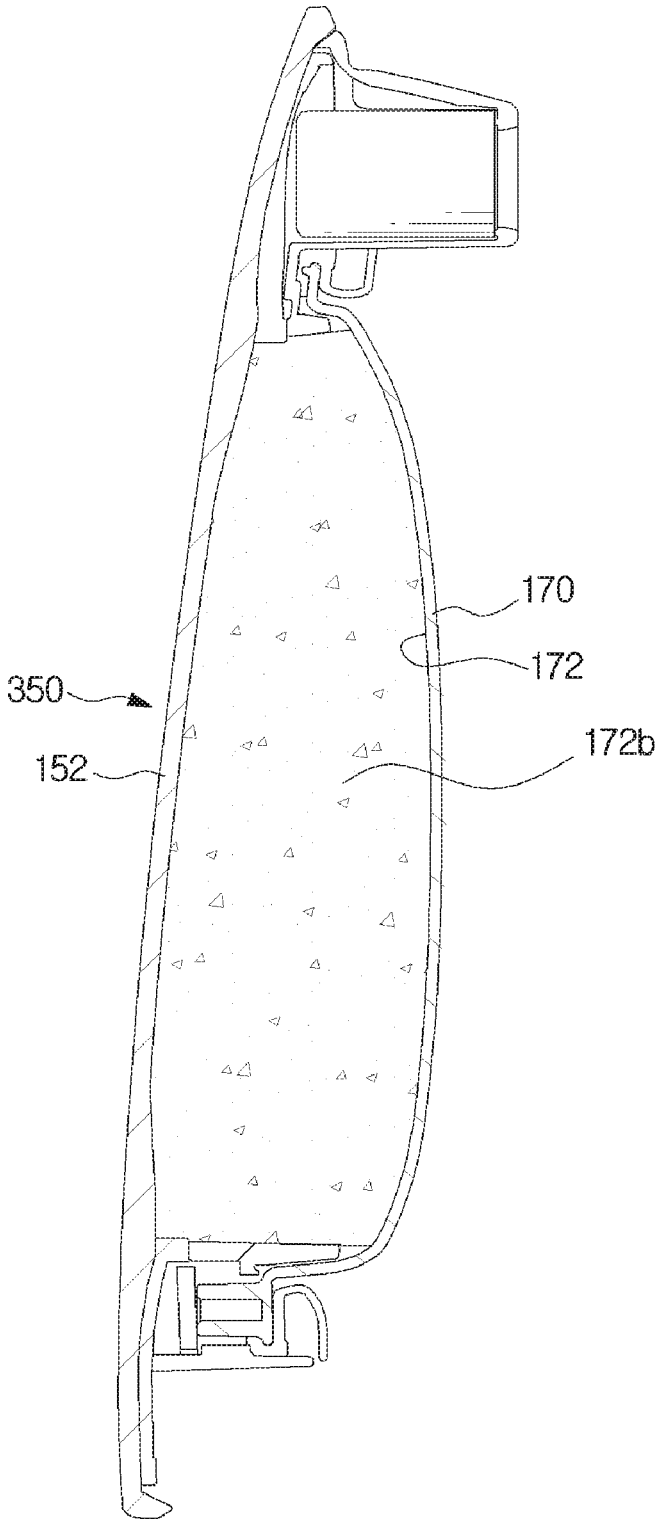
FIG. 16 is a cross-sectional view of an auxiliary door according to still another embodiment of the present disclosure.

FIG. 16 is a cross-sectional view of an auxiliary door according to still another embodiment of the present disclosure.

An inner door 170 is provided to form an insulating space 172 between an auxiliary door body 152 and the inner door 170. The insulating space 172 is disposed between the inner door 170 and the auxiliary door body 152, and heat is prevented from being transmitted from the washing machine through a second opening 112*a* when an auxiliary door 350 is located at the closed position 150*b*.

An insulating material 172*b* may be disposed in the insulating space 172. The type of the insulating material 172*b* is not limited and the insulating material 172*b* insulating heat to prevent the heat from being transmitted from the inner door 170 to an outer door may be adequate.

A shape and disposition of the insulating material 172*b* in the insulating space 172 are not limited, and a plurality of types of insulating materials 172*b* may be provided in layers.

While the present disclosure has been particularly described with reference to exemplary embodiments, it should be understood by those of skilled in the art that various changes in form and details may be made without departing from the spirit and scope of the present disclosure.

What is claimed is:

1. A washing machine comprising:

a cabinet having a first opening and having a washing space formed therein; and a door assembly provided to open and close the first opening, wherein the door assembly includes:

a door body having a second opening, a door glass having a glass hole, a guide duct configured to connect to the second opening of the door body and the glass hole of the door glass; and a sealing member configured to couple the glass hole and the guide duct.

2. The washing machine of claim 1, further comprising an auxiliary door configured to open and close the second opening.

3. The washing machine of claim 1, wherein the sealing member includes a sealing cap having one end connected with one end of the guide duct and an other end connected with the glass hole.

4. The washing machine of claim 3, wherein the sealing cap includes a coupling groove formed to be concave along a circumference of the one end of the sealing cap, and the one end of the guide duct is inserted into and coupled to the coupling groove.

5. The washing machine of claim 3, wherein:

the sealing cap includes a catcher extending from the sealing cap along a circumference of the other end of the sealing cap; and the guide duct includes a catching protrusion protruding from the one end of the guide duct along an outer circumferential surface thereof to catch a catching groove.

6. The washing machine of claim 4, wherein the sealing member includes a sealing ring having a ring shape and located between the coupling groove and a coupling protrusion.

7. The washing machine of claim 3, wherein the sealing member further includes a sealing agent configured to attach the other end of the sealing cap to the door glass.

8. The washing machine of claim 7, wherein the sealing cap further includes a sealing cap contact surface which faces the door glass and to which the sealing agent is applied.

9. The washing machine of claim 8, wherein the sealing cap includes a contact rib protruding farther from an outer edge of the sealing cap contact surface than the sealing cap contact surface to prevent the sealing agent from being leaked.

10. The washing machine of claim 9, wherein the contact rib includes:

a first contact rib which is adjacent to the sealing cap contact surface; and a second contact rib formed to be separated a predetermined distance from the first contact rib.

11. The washing machine of claim 10, wherein the sealing member further includes a rib contact ring disposed between the first contact rib and the second contact rib to seal a gap between the sealing cap and the door glass.

12. The washing machine of claim 3, wherein the door glass includes an introduction preventing protrusion formed around the sealing member and formed to protrude toward an inside of the cabinet.

* * * * *